United States Patent [19]

Johnson

[11] 4,411,774

[45] Oct. 25, 1983

[54] PROCESS FOR REMOVING CONTAMINANTS FROM WASTE LUBRICATING OIL BY CHEMICAL TREATMENT

[75] Inventor: Conrad B. Johnson, Edmonton, Canada

[73] Assignee: Turbo Resources Ltd., Edmonton, Canada

[21] Appl. No.: 354,955

[22] Filed: Mar. 5, 1982

Related U.S. Application Data

[63] Continuation-in-part of Ser. No. 225,792, Jan. 16, 1981, abandoned.

[51] Int. Cl.[3] ..... C16M 11/00

[52] U.S. Cl. ..... 208/179; 208/181; 208/252; 208/253

[58] Field of Search ..... 208/179, 181, 253, 252

[56] References Cited

U.S. PATENT DOCUMENTS

| | | | |
|---|---|---|---|
| 1,523,547 | 1/1925 | Le Vora | 208/181 |
| 1,828,429 | 10/1931 | Moreton et al. | 208/179 |
| 2,919,245 | 12/1959 | Wolfe | 208/252 |
| 3,459,658 | 9/1969 | Langlois et al. | 208/252 |
| 3,622,505 | 11/1971 | Tilley et al. | 208/252 |
| 3,879,282 | 4/1975 | Johnson | 208/179 |
| 3,930,988 | 1/1976 | Johnson | 208/182 |
| 4,033,859 | 7/1977 | Davidson et al. | 208/179 |
| 4,151,072 | 4/1979 | Nowack et al. | 208/182 |
| 4,204,946 | 5/1980 | Johnson | 208/181 |
| 4,247,389 | 1/1981 | Johnson et al. | 208/181 |
| 4,250,021 | 2/1981 | Salusinszky | 208/181 |

FOREIGN PATENT DOCUMENTS

| | | | |
|---|---|---|---|
| 1006888 | 10/1965 | United Kingdom | 208/179 |
| 1192541 | 5/1970 | United Kingdom | 208/179 |

*Primary Examiner*—Delbert E. Gantz
*Assistant Examiner*—Cynthia A. Prezlock
*Attorney, Agent, or Firm*—E. P. Johnson

[57] ABSTRACT

A process is provided for removing contaminants from waste lubricating oil. The waste oil is contacted with one or more of the pretreatment chemicals ammonium sulphate, ammonium bisulphate, ammonium dihydrogen phosphate, diammonium phosphate, calcium hydrogen phosphate, phosphoric acid, calcium sulphate, aluminum sulphate, and magnesium sulphate. The contacting step is performed at a temperature of at least about 650° F. The oil mixture is then filtered to remove the contaminants. The pretreatment chemical is preferably added in the absence of water, thereby reducing the amount of water to be removed from the oil.

6 Claims, 1 Drawing Figure

PROCESS FOR REMOVING CONTAMINANTS FROM WASTE LUBRICATING OIL BY CHEMICAL TREATMENT

CROSS-REFERENCE TO RELATED APPLICATION

This application is a continuation-in-part of my application for U.S. Letters Patent Ser. No. 225,792 filed Jan. 16, 1981, now abandoned.

FIELD OF THE INVENTION

The invention relates to a process for removing contaminants from waste lubricating oil. More particularly the invention involves contacting the waste oil with a pretreatment chemical and thereafter filtering the waste oil to remove the contaminants.

BACKGROUND OF THE INVENTION

Waste lubricating oils include used motor oil, diesel oil, crankcase oil, transmission oil, and the like, usually collected from gasoline service stations. These waste oils contain a number of contaminants arising both from their use and from additives added prior to their use. These contaminants, for the most part, include calcium, barium, zinc, aluminum and phosphorus arising from detergent dispersant agents, iron from engine wear, lead and light end hydrocarbons from gasoline, and water. In order to reuse these oils, the contaminants must be substantially removed.

Due to the high viscosity of the oil, the fine colloidal or dissolved form of the contaminants and the dispersing nature of the additives, the contaminants cannot be removed by a simple filtration procedure without some preliminary treatment.

The most widely used process for upgrading waste oils is the acid-clay process. In accordance with this process, waste oil is contacted with high strength sulphuric acid and the contaminants are removed in an acid sludge. The oil is thereafter contacted with a decolorizing clay to absorb additional contaminants and color bodies.

There are a number of problems associated with this process. Firstly, the process produces large amounts of acid sludge which must be disposed of. Secondly, large volumes of corrosive acid are consumed by the process. Thirdly, up to 20% of the original waste oil is lost with the acid sludge.

Other methods have been proposed for reprocessing waste oil by obtaining a metathesis reaction with the contaminants by adding an aqueous solution of pretreatment chemicals, which precipitates the metals to render them phase separable from the oil. In U.S. Pat. No. 3,930,988 issued to M. Johnson, waste oil is contacted with an aqueous solution of ammonium sulphate and/or ammonium bisulphate to precipitate the metals into an aqueous phase, separable from the oil base. In U.S. Pat. No. 3,879,282, also issued to M. Johnson, waste oil is contacted with an aqueous solution of one or more of triammonium phosphate, diammonium hydrogen phosphate, and ammonium dihydrogen phosphate. In U.S. Pat. No. 4,204,946 issued to the present inventor, waste oil is contacted with an aqueous solution of ammonium sulphate and aluminum sulphate. In all of the above processes, the pretreatment chemicals are added to the waste oil in an aqueous solution and the metals are separated in an aqueous phase. Also, the temperature of the reaction is limited to about 200°–500° F. High temperature treatments have generally been avoided when reprocessing waste lubricating oils to avoid cracking of the oil.

In U.S. Pat. No. 4,151,072, issued to M. Johnson, a process is described for reprocessing waste oil wherein the oil is contacted with an aqueous solution of an ammonium salt such as ammonium phosphate. The temperature of the oil is raised gradually through one or more contacting vessels to a final temperature of less than about 400° F. to initially achieve a phosphate replacement reaction with the contaminants, and to remove water and light hydrocarbons. The oil is then filtered using a filter aid. It should be noted that the above process again requires that the pretreatment chemicals be added in an aqueous phase, and the temperature of reaction be limited to about 140°–390° F.

SUMMARY OF THE INVENTION

The process of the present invention is based on a number of discoveries by the inventor. It was found that at high temperatures, of at least about 650° F., waste lubricating oil could be contacted with a pretreatment chemical, without causing undue cracking of the oil, and thereafter be filtered to yield an oil product significantly reduced in contaminant content. It was also discovered that the pretreatment chemical need not be added to the waste oil in an aqueous phase to obtain this reaction. This fact encouraged the inventor to test a large number of pretreatment chemicals, and it was found that the chemicals used in the present process did not need to be water soluble, as was previously thought necessary.

In accordance with the process of the present invention a waste lubricating oil is contacted with one or more of the pretreatment chemicals selected from the group consisting of ammonium sulphate, ammonium bisulphate, diammonium phosphate, ammonium dihydrogen phosphate, calcium hydrogen phosphate, phosphoric acid, calcium sulphate, aluminum sulphate, sodium sulphate, and magnesium sulphate. The contacting step is performed at a temperature of at least about 650° F. This high temperature of at least about 650° F. is used to ensure removal of light hydrocarbon ends from the waste oil. Lubricating oils generally are defined as having a boiling point above at least about 650° F. The oil mixture is thereafter filtered to obtain a filtrate product reduced in contaminant content. The pretreatment chemical is preferably added to waste oil in the absence of water.

It is believed that a different mechanism may be operating in the present process than in the previous low temperature processes using an aqueous phase. While not wishing to be bound by the same, it is believed that the high temperatures used in the present process result in the desctruction of the detergents and dispersants which might otherwise have combined with metals, such as calcium. Dispersants and detergents can drastically impair the filterability of the waste oil and thereby render a process inoperative. Whereas it was previously thought that calcium, especially calcium sulphate, impurities in the pretreatment chemicals were highly undesirable, the present process succeeds with calcium sulphate being used alone as a pretreatment chemical, or in combination with other pretreatment chemicals.

Broadly stated, the invention is a process for removing contaminants from waste lubricating oil comprising the steps of: contacting the waste lubricating oil with a pretreatment chemical selected from the group consisting of ammonium sulphate, ammonium bisulphate, ammonium dihydrogen phosphate, diammonium phosphate, calcium hydrogen phosphate, phosphoric acid, calcium sulphate, aluminum sulphate, magnesium sulphate, sodium sulphate and mixtures thereof, at a temperature of at least about 650° F. for a time sufficient to render at least about a portion of the contaminants removable by filtration; and then filtering the oil mixture to obtain a filtrate product reduced in contaminant content.

DESCRIPTION OF THE PREFERRED EMBODIMENT

Figure 1:
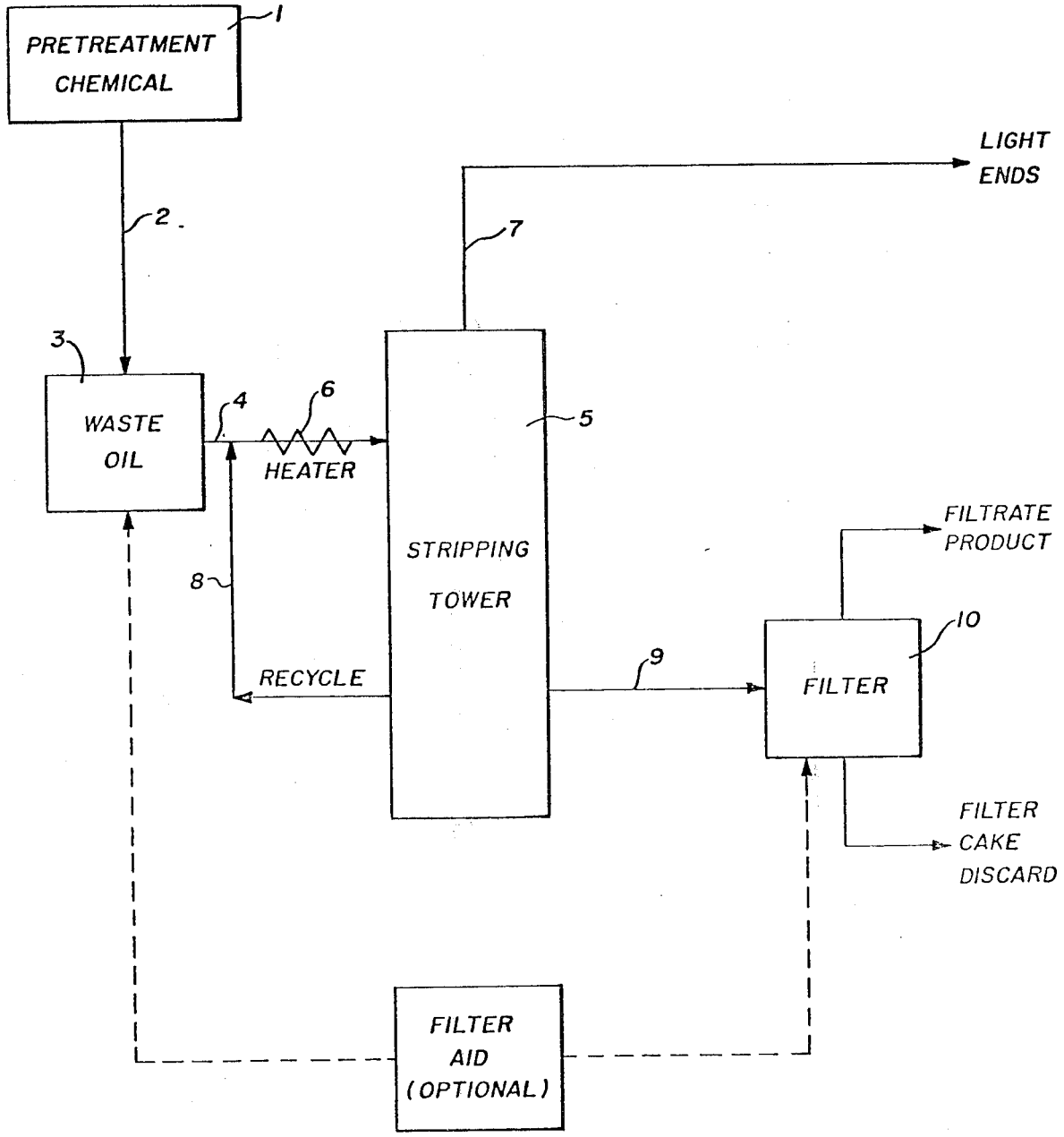
FIG. 1 is a schematic illustration of the process of the present invention.

The waste lubricating oil feedstock for the process of the present invention is generally derived from the drained discard oils accumulated at gasoline service stations. These oils include motor oils, crankcase oils, transmission oils, hydraulic oils and the like. Contaminants included in these oils are chiefly calcium, barium, zinc, aluminum, iron and phosphorus containing compounds, hereinafter referred to as metal contaminants, together with water and light hydrocarbons, hereinafter referred to as light end contaminants. The metal contaminants are usually present in concentrations of about 1–2% wt/vol in the oil. The light end contaminants usually account for about 10–15% volume of the oil.

In the practice of the present invention the waste lubricating oil is contacted with a selected pretreatment chemical at a high temperature for a period of time sufficient to render at least a portion of the contaminants removable by filtration. The oil mixture is then filtered to produce an oil filtrate product reduced in contaminant content.

The waste oil is preferably treated directly by the present process without preliminary light ends stripping. Since the contacting step of the process utilizes a high temperature, light ends stripping is conveniently performed simultaneously with this step. Alternatively of course the process may be practiced with a preliminary, intermediate or final light ends stripping step.

The contacting step is conducted at a temperature of at least about 650° F. As mentioned previously, lubricating oils generally have a boiling point above at least about 650° F. Contacting at this temperature or greater therefore ensures removal of the undesirable light end contaminants. Also, temperatures below about 650° F. can increase the contacting time or result in an oil mixture which is not easily filtered. At temperatures above 725° F., undue cracking of the waste oil may take place. Typically a temperature of about 660° F., maintained for about 4 hours, has been found to be sufficient. It is generally the filterability of the oil mixture which determines the completeness of the contacting step.

The contacting step is preferably performed at atmospheric pressure. If desired however the pressure may be elevated, for instance to the vapor pressure resulting at the elevated contacting temperature in a closed vessel.

The conditions used during the contacting step vary with the properties of the waste oil, the type and amount of pretreatment chemical used, and the desired filtration rate. These conditions may be determined by routine experimentation in the laboratory.

The pretreatment chemicals which have been found to be effective in this process include one or more of ammonium sulphate, ammonium bisulphate, ammonium dihydrogen phosphate, diammonium sulphate, calcium hydrogen phosphate, phosphoric acid, calcium sulphate, aluminum sulphate, sodium sulphate, and magnesium sulphate.

The amount of the pretreatment chemical included in the waste oil varies with the type of chemical used. In most cases the amount of the pretreatment chemical included is preferably at least equal to or greater than the amount of contaminants in the oil. A typical waste oil includes about 1% wt/vol. contaminants.

The inventor has found more particularly that the abovenamed pretreatment chemicals can be divided into two groups in accordance with their effect on the waste oil during the contacting step. Group I chemicals, including ammonium sulphate, ammonium bisulphate, ammonium dihydrogen phosphate, diammonium phosphate, calcium hydrogen phosphate, phosphoric acid, magnesium sulphate and mixtures thereof, when included in amounts greater than about 0.5% wt/vol and more preferably in an amount of about 1% wt/vol, produce an oil mixture with good filterability characteristics. Such oil mixtures, when filtered, yield an oil filtrate product from which the majority of the metal contaminants have been removed. This latter property is hereinafter referred to as good metals removal. The Group I chemicals appear to be able to destroy, at low concentrations, the detergents and dispersants in the waste oil which can otherwise give poor filtration rates. It should be pointed out that the abovementioned quantities of the pretreatment chemicals refers to the total percent weight in grams of the chemical per volume in milliliters of the waste oil.

Group II pretreatment chemicals, including calcium sulphate, aluminum sulphate sodium sulphate, and mixtures thereof, when included in an amount greater than about 4% wt/vol, and more preferably in an amount of about 5% wt/vol, produce an oil mixture which, when filtered, has a good reduction in color bodies. This color reduction is usually better than that achieved with a Group I chemical. The Group II chemical may be included in an amount less than 4% wt/vol and still give good color bodies and metals removal, however the filterability of the thus treated oil mixture is reduced.

One or more of the Group I and Group II chemicals can be included together in the contacting step to combine the ability of the Group I chemical to produce a filterable oil product, and the ability of the Group II chemical to remove color bodies. In this case the Group I chemical is preferably included in an amount less than about 0.5% wt/vol and the Group II is preferably included in an amount greater than about 2% wt/vol. While the Group I chemical can be included in amounts greater than about 0.5% wt/vol, this has been found not to significantly improve the filtration rate over that obtained at 0.5% wt/vol.

Fertilizer grade diammonium phosphate (11-46-0) has been successfully used in the process as has calcium sulphate obtained as a by-product in fertilizer manufacturing. The fact that the above two reagents are useful pretreatment agents is surprising since it was previously thought that the presence of gypsum in a process for re-refining waste oil was undesirable. The use of fertilizer grade diammonium phosphate and fertilizer by-product calcium sulphate in the present process is advantageous over other chemicals since they are both readily available and inexpensive. The fertilizer by-product calcium sulphate is particularly attractive because of its low cost. It should be understood that the term calcium sulphate, as used in the disclosure and the claims, is meant to include all sources of calcium sulphate available either as a technical grade chemical or in an impure form of an industrial by-product.

The inventor has found that the presence of calcium phosphate or calcium oxide in the present process deleteriously affects the filtration rate. Pretreatment chemicals containing such contaminants are preferably not used.

It has been found that the pretreatment chemicals can be added to the waste oil in the absence of water without deleteriously affecting the removal of the contaminants by the present process. Thus the pretreatment chemical is preferably added in a dry form to the waste oil to reduce the amount of water which must be subsequently removed from the oil, and to eliminate the need for the preliminary dissolution of pretreatment chemical in water.

The pretreatment chemical is preferably added to the oil in a finely divided form. Depending on the chemical used, it may be desirable to grind or crush the chemical before adding it to the oil.

After the contacting step, the oil-chemical mixture is filtered by, for instance, gravity or vacuum filtration. The filtration step is preferably performed at an elevated temperature in the range of about 200°–350° F., or at an elevated temperature which will not damage the filter or the filter seals, in order to reduce the oil viscosity and thus increase the filtration rate.

It may be desirable to include a filter aid to improve the filtration rate of the oil-chemical mixture. Filter aids, for example diatomaceous earth, are well known in the art of reclaiming waste lubricating oil. The filter aid may be used as a filter precoat in the filtration step or more preferably may be added directly to the waste oil before the contacting step. If desired, the filter aid may be used both directly in the oil and as a filter precoat. The amount of the filter aid included is not critical, an amount of about 1% wt/vol is usually suitable. The filter aid has its greatest value to the process when low levels of pretreatment chemicals are used.

As mentioned previously, it is advantageous to conduct light ends stripping from the waste oil during the contacting step. To that end the heated oil is purged with a nitrogen or steam stream during the contacting step to remove the volatile light ends. The light ends are recovered by, for instance, an overhead condensor system.

The filtrate product obtained from the present process is usually acceptable for non-critical oil uses. For a higher grade of re-refined oil, the filtrate product may be further processed by conventional oil upgrading techniques including hydrotreating, acid-clay contacting, and vacuum distillation.

The process of the present invention is further illustrated in FIG. 1. The pretreatment chemical is added from tank 1 through line 2 to the waste lubricating oil in tank 3. The pretreatment chemical, as mentioned previously, is preferably added in dry form. The oil and chemical are preferably mixed in the tank 3. The oil-chemical mixture is then passed through a line 4 to a stripping tower 5. A heater 6 in the line 4 rapidly heats the mixture to a temperature of about 660° F. At this high temperature, the light end contaminants in the waste oil flash, and are removed and condensed overhead of the stripping tower through line 7.

The oil-chemical mixture is maintained in the stripping tower at a temperature of about 660° F. for a time sufficient to render the contaminants removable by filtration, typically for about 4 hours. The mixture is preferably mixed during this time. To that end the mixture is recycled through line 8, preferably back through the heater 6, to the tower 5.

Following this contacting step, the mixture is removed from the stripping tower 5 through a line 9 to a filter 10. The oil mixture is preferably filtered at a temperature of about 300° F. to produce a filtrate product reduced in contaminants, and a solid filter cake for discard.

A filter aid, such as diatomaceous earth, is optionally added as a precoat to the filter 10. More preferably, the filter aid is added to the waste oil in the tank 3, and therefore is included in the high temperature contacting step.

The present process is further illustrated in the following example.

EXAMPLE I

The following example is included to show the operability of the present process with a number of the possible pretreatment chemicals, and to further show that the chemical need not be added to the waste oil in an aqueous solution. Further, the example shows that the process can be improved with the addition of a filter aid, in this case diatomaceous earth, either in the contacting step, or as a filter precoat.

A number of oil samples were taken from a feedstock of waste lubricating oil and subjected to the various treatments to be described. The oil was a typical wet waste oil without preliminary dehydration, light hydrocarbons removal or demetallization treatment. Prior to each run the oil was air rolled to ensure sample uniformity. An atomic absorption analysis of the untreated waste oil showed the following metals present in the indicated ppm concentrations: Sn 10, Pb 7845, Cu 35, Al 25, Si 30, Fe 485, Cr 15, Ag 0, Zn 1380, Mg 350, Ni 3, Ba 210, Na 90 Ca 1490, V 2, P 950, Mo 2, B 20, and Mn 20.

Five hundred milliliter samples of the waste oil were transferred to a 1-liter, three-necked flask equipped with a nitrogen purge and an overhead condensor for light ends stripping. The desired amount of the pretreatment chemical was added to the oil, and the oil-chemical mixture was heated at atmospheric pressure at 660° F. for 4 hours. The mixture was then cooled to about 300° F. and vacuum filtered through prewetted #4 and #1 Whatman filter papers in an 11 cm Buchner funnel. Approximate filtration rates are recorded in Table I.

The amount of the light ends stripped, together with the analyses of the filtered products are reported in Table I. The metal contaminant content was determined by atomic absorption.

The oil filtrate product was then further upgraded by a conventional acid-clay treatment or by hydrotreating. For the former upgrading process a 100 ml portion of the filtrate was treated with 0.5 ml of concentrated sulphuric acid, with air rolling for 4 hours. The acid mixture was gravity settled and the oil layer decanted. The oil layer was thereafter contacted with 5 g of Pembina 105 clay (obtained from Pembina Mountain Clay, Winnipeg, Manitoba) at 355° F. and filtered. After filtration the color of the oil was determined by a Hellige Comparator, and the transmittance determined by a Lumetron Colorimeter at 650 nm (red filter) and 580 nm (brown filter). The weight of the original filtrate lost in acid sludge was also determined. These analyses are recorded in Table II.

To obtain a color reduction as noted in Table II by a straight forward acid-clay treatment would require approximately 6% vol/vol $H_2SO_4$. Thus the above preliminary chemical pretreatment process significantly reduces the quantity of acid consumed.

A further 200 ml portion of the filtered oil product was hydrotreated using 10 g of a Nalco 474 Co-Mo, 1/16" catalyst extrudate (obtained from C.I.L., Edmonton, Alberta) at 650° F. and 650 psig for 4 hours in a stirred high pressure batch reactor (Parr-Model 4563). The product was cooled overnight and then filtered to remove any catalyst fines. The color and transmittance of the hydrotreated product are recorded in Table II.

From the product analyses after hydrotreatment it can be seen that the preliminary chemical pretreatment process of the present invention produced an oil product sufficiently reduced in contaminant content to be upgraded directly by conventional hydrotreating. From the metal analyses in Table I, it can be seen that the filtered oil product, prior to further upgrading is suitable for non-critical oil uses. It is particularly important to note the low levels of calcium and lead in the filtrate product of the present invention. These elements are two of the major potential catalyst poisons in the subsequent hydrotreatment step. In the low levels noted in Table I, these metals do not significantly impair the hydrotreating step.

TABLE I

| Sample No. | Pretreatment Chemical % wt/vol (g/ml) | Light Ends Removed (% vol) | Light Ends Description | Residue (% wt/vol of feed) | Filtration time (min.) | Filtrate Product Pb (ppm) | Zn (ppm) | Ca (ppm) | Al (ppm) | Fe (ppm) |
|---|---|---|---|---|---|---|---|---|---|---|
| 1 | None | 4.40 | murky, dark | 3.50 | 480+ | 0.0 | 0.0 | 0.0 | 0.0 | 0.0 |
| 2 | None* | 3.40 | murky, dark | 4.70 | 480+ | 0.0 | 7.0 | 0.4 | 0.0 | 0.3 |
| 3 | Diatomaceous Earth (1.0) | 3.60 | clear, light | 3.60 | 30 | 0.0 | 0.0 | 0.1 | 0.0 | 0.0 |
| 4 | $(NH_4)_2SO_4$ (1.06) | 11.60 | clear, light | 2.74 | 60 | 1.2 | 0.0 | 0.5 | 0.0 | 0.0 |
| 5 | $(NH_4)_2SO_4$** (1.06) | 4.60 | clear, light | 2.54 | <30 | 0.0 | 0.0 | 0.1 | 0.0 | 0.0 |
| 6 | $(NH_4)_2SO_4$* (1.06) | 14.00 | clear, light | 3.54 | 60 | 1.6 | 0.9 | 4.4 | 0.0 | 0.0 |
| 7 | $(NH_4)_2SO_4$ (1.06) Diatomaceous Earth (1.0) | 9.20 | clear, light | 2.64 | <15 | 0.9 | 0.0 | 0.5 | 0.0 | 0.0 |
| 8 | $(NH_4)_2HPO_4$** (1.06) | 4.00 | clear, light | 3.34 | <15 | 0.0 | 0.0 | 0.0 | 0.0 | 0.0 |
| 9 | $(NH_4)_2HPO_4$ (1.06) | 6.60 | clear, light | 2.44 | 30 | 2.1 | 0.0 | 0.4 | 0.0 | 0.0 |
| 10 | $(NH_4)_2HPO_4$* (1.06) | 9.40 | clear, light | 3.94 | 30 | 1.0 | 0.0 | 0.7 | 0.0 | 0.0 |
| 11 | $(NH_4)_2HPO_4$ (1.06) Diatomaceous Earth (1.0) | 9.00 | clear, light | 2.74 | 15 | 0.8 | 0.0 | 0.5 | 0.0 | 0.1 |
| 12 | $Al_2(SO_4)_3$** (1.03) | 10.60 | clear, light | 3.77 | 120 | 0.0 | 0.0 | 0.0 | 0.0 | 0.0 |
| 13 | $CaSO_4$(1.08) | 6.00 | clear, light | 3.21 | 120 1.0 | 0.3 | 0.7 | 0.0 | 0.0 | |
| 14 | $(NH_4)_2SO_4$ (0.33) $Al_2(SO_4)_3$ (0.68) | 6.00 | clear, light | 5.99 | 120 | 0.2 | 0.0 | 0.3 | 0.0 | 0.0 |
| 15 | $(NH_4)_2SO_4$ (0.68) $Al_2(SO_4)_3$ (0.32) | 5.40 | clear, light | 6.00 | 120+ | 0.8 | 0.0 | 0.8 | 0.0 | 0.0 |
| 16 | $(NH_4)_2SO_4$ (0.33) $Al_2(SO_4)_3$ (0.68) | 13.40 | clear, light | 5.79 | 120+ | 1.2 | 0.0 | 1.6 | 0.0 | 0.0 |
| 17 | $(NH_4)_2SO_4$ (0.33) $Al_2(SO_4)_3$ (0.68) Diatomaceous Earth (1.0) | 11.20 | clear, light | 6.19 | 60 | 0.5 | 0.0 | 0.5 | 0.0 | 0.0 |
| 18 | $CaSO_4$ (0.52) $Al_2(SO_4)_3$ (0.34) | 9.40 | murky, dark | 3.64 | 120+ | 1.0 | 0.1 | 0.8 | 0.0 | 0.1 |
| 19 | $(NH_4)_2HPO_4$ (1.06) $CaSO_4$ (0.27) | 5.00 | clear, light | 3.07 | 30 | 0.6 | 0.0 | 0.6 | 0.0 | 0.0 |
| 20 | $(NH_4)_2HPO_4$ (1.06) $CaHPO_4$ (0.94) | 6.20 | clear, light | 3.91 | 60 | 0.5 | 0.0 | 0.9 | 0.0 | 0.0 |
| 21 | $(NH_4)_2HPO_4$ (0.53) $CaHPO_4$ (0.94) $CaSO_4$ (0.54) | 15.00 | clear, light | 2.29 | 15 | 0.6 | 0.0 | 0.4 | 0.0 | 0.0 |

*Filter Aid added as Filter Precoat
**Pretreatment Chemicals added in Aqueous Solution and Filter Aid added as Filter Precoat

TABLE II

| Sample No. | Pretreatment Chemical % wt/vol (g/ml) | Filtrate Product Further Upgraded By Acid Treating (0.5% vol/vol) and Clay Contacting (5% wt/vol) Color NPA | Transmittance % at 650 nm | Transmittance % at 580 nm | Filtrate Lost As Acid Sludge % wt/vol | Filtrate Product Further Upgraded by Hydrotreating (650° F. 650 psig) Color NPA | Transmittance % at 650 nm | Transmittance % at 580 nm |
|---|---|---|---|---|---|---|---|---|
| 1 | None | 5/6 | 65 | 39 | 3.2 | 7/8 | 37 | 16 |
| 2 | None* | 4½/5 | 77 | 55 | 3.2 | 4½/5 | 60 | 40 |
| 3 | Diatomaceous Earth (1.0) | 4½/5 | 83 | 64 | 2.8 | 7/8 | 22 | 9 |
| 4 | $(NH_4)_2SO_4$ (1.06) | 4½/5 | 80 | 60 | 2.9 | 6/7 | 41 | 21 |
| 5 | $(NH_4)_2SO_4$** (1.06) | 4½/5 | 78 | 58 | 3.6 | 8+ | 9 | 2 |
| 6 | $(NH_4)_2SO_4$* (1.06) | 4½/5 | 82 | 62 | 3.5 | 5/6 | 60 | 32 |
| 7 | $(NH_4)_2SO_4$ (1.06) Diatomaceous Earth (1.0) | 4½/5 | 73 | 49 | 3.6 | 8+ | 17 | 5 |
| 8 | $(NH_4)_2HPO_4$** (1.06) | 4½/5 | 79 | 57 | 3.4 | 8 | 14 | 4 |
| 9 | $(NH_4)_2HPO_4$ (1.06) | 4½/5 | 82 | 61 | 2.9 | 1 | 35 | 15 |
| 10 | $(NH_4)_2HPO_4$* (1.06) | 4/4½ | 89 | 72 | 3.1 | 8+ | 22 | 8 |
| 11 | $(NH_4)_2HPO_4$ (1.06) Diatomaceous Earth (1.0) | 4/4½ | 87 | 70 | 2.8 | 5/6 | 66 | 39 |

TABLE II-continued

| Sample No. | Pretreatment Chemical % wt/vol (g/ml) | Filtrate Product Further Upgraded By Acid Treating (0.5% vol/vol) and Clay Contacting (5% wt/vol) Color NPA | Trans-mittance % at 650 nm | Trans-mittance % at 580 nm | Filtrate Lost As Acid Sludge % wt/vol | Filtrate Product Further Upgraded by Hydrotreating (650° F. 650 psig) Color NPA | Transmittance % at 650 nm | Transmittance % at 580 nm |
|---|---|---|---|---|---|---|---|---|
| 12 | $Al_2(SO_4)_3$** (1.03) | 4/4½ | 89 | 73 | 2.7 | 5/6 | 49 | 27 |
| 13 | $CaSO_4$ (1.08) | 4½/5 | 85 | 64 | 2.8 | 6/7 | 35 | 17 |
| 14 | $(NH_4)_2SO_3$ (0.33) $Al_2(SO_4)_3$ (0.68) | 4/4½ | 85 | 67 | 3.3 | 6/7 | 32 | 15 |
| 15 | $(NH_4)_2SO_4$ (0.68) $Al_2(SO_4)_3$ (0.32) | 4½ | 84 | 65 | 3.3 | 6/7 | 40 | 21 |
| 16 | $(NH_4)_2SO_4$ (0.33) $Al_2(SO_4)_3$ (0.68) | 4½/5 | 79 | 58 | 3.2 | 5/6 | 55 | 30 |
| 17 | $(NH_4)_2SO_4$ (0.33) $Al_2(SO_4)_3$ (0.68) Diatomaceous Earth (1.0) | 5/6 | 58 | 33 | 3.2 | 6/7 | 35 | 17 |
| 18 | $CaSO_4$ (0.52) $Al_2(SO_4)_3$ (0.34) | 4/4½ | 85 | 67 | 2.9 | 4½/5 | 61 | 40 |
| 19 | $(NH_4)_2HPO_4$ (1.06) $CaSO_4$ (0.27) | 4½/5 | 81 | 60 | 2.9 | 5/6 | 65 | 40 |
| 20 | $(NH_4)_2HPO_4$ (1.06) $CaHPO_4$ (0.94) | 4/4½ | 86 | 69 | 2.3 | 7/8 | 23 | 11 |
| 21 | $(NH_4)_2HPO_4$ (0.53) $CaHPO_4$ (0.94) $CaSO_4$ (0.54) | 4/4½ | 87 | 71 | 3.1 | 8+ | 16 | 5 |

*Filler Aid Added As Filter Precoat
**Pretreatment Chemical Added in Aqueous Solution and Filter Aid Added As Filter Precoat

EXAMPLE II

This example is included to show operability of the present process with one or more of the possible pretreatment chemicals in the preferred concentration ranges.

As in Example I, a number of oil samples (500 ml) were taken from an air rolled feedstock of waste lubricating oil. The analysis of the waste oil prior to treatment is given in Table IV below. Each of the samples was contacted and filtered in the manner described in Example I. The amount of pretreatment chemical, the contacting temperature and the contacting time used for each sample is given in Tables III and IV below. Approximate filtration times are also reported in Table III.

The filtered oil product was analysed for viscosity and metals removal. The results are given in Table IV.

As is evident from the results, the present process is most effective in rendering the waste oil filterable and in removing metal contaminants, when the contacting step is conducted at a temperature of at least about 650° F. Filtration rates and metals removable are usually reduced when the contacting temperature is dropped to 500° F. or 600° F. This is especially evident when the pretreatment chemical in the contacting step is a Group II chemical such as $CaSO_4$.

The results also show that the contacting times can be significantly reduced as the contacting temperature is increased.

The results also show that the contacting step of the process is effective, in terms of rendering the oil filterable and removing metals, with an amount of a Group I chemical of about 1.0% wt/vol or with an amount of a Group II chemical of about 5.0% wt/vol. The results also show that the contacting step is effective when practiced with both a Group I chemical and a Group II chemical in amounts of about 0.5% wt/vol and 2.5% wt/vol respectively.

The following advantages or features arise from the practice of the process of the present invention:

1. By contacting at a temperature of at least about 650° F., light ends are removed from the waste lubricating oil.
2. After contacting the waste lubricating oil for a sufficient time at the high temperature of at least about 650° F., the oil can be filtered to remove contaminants.
3. The oil filtrate product has a substantially reduced content of metal contaminants.
4. When a Group II chemical is used in the contacting step, the resulting oil filtrate product has a substantially reduced content of color bodies.

TABLE III

| Sample No. | Pretreatment Chemical % wt/vol | Contacting Temp. (°F.) | Contacting Time (hr.) | Light Ends Removed (% vol) | Filtration: Residue (% wt/vol of feed) | % Filtered in 5 Min. | % Filtered in 15 Min. | % Unfiltered after 4 Hr. |
|---|---|---|---|---|---|---|---|---|
| 22 | $CaSO_4.2H_2O$ (5.0) | 650 | 4.0 | 2.6 | 7.7 | 80 | 100 | 0 |
| 23 | $H_3PO_4$(85%) (1.0) | 650 | 4.0 | 4.6 | 3.0 | 100 | 100 | 0 |
| 24 | $CaSO_4.2H_2O$ (2.5) $H_3PO_4$(85%) (0.5) | 650 | 4.0 | 6.4 | 6.6 | 100 | 100 | 0 |
| 25 | $CaSO_4.2H_2O$ (2.0) | 650 | 4.0 | 5.4 | 4.5 | 50 | 90 | 0 |
| 26 | $MgSO_4.7H_2O$ (5.0) | 650 | 4.0 | 10.3 | 18.0 | 100 | 100 | 0 |
| 27 | Gypsum (5.0) | 650 | 4.0 | 8.1 | 6.4 | 100 | 100 | 0 |
| 28 | $Al_2SO_4.18H_2O$ (5.0) | 650 | 4.0 | 10.0 | 22.1 | 100 | 100 | 0 |
| 29 | $NH_4H_2PO_4$ (1.0) | 650 | 4.0 | 5.8 | 3.7 | 100 | 100 | 0 |
| 30 | $NH_4HSO_4$ (1.0) | 650 | 4.0 | 10.8 | 2.7 | 100 | 100 | 0 |
| 31 | $MgSO_4.7H_2O$ (1.0) | 650 | 4.0 | 6.0 | 3.2 | 75 | 100 | 0 |
| 32 | $CaHPO_4$ (1.0) | 650 | 4.0 | 5.6 | 4.4 | 100 | 100 | 0 |

TABLE III-continued

| Sample No. | Pretreatment Chemical % wt/vol | Contacting Temp. (°F.) | Contacting Time (hr.) | Light Ends Removed (% vol) | Filtration: Residue (% wt/vol of feed) | Filtration: % Filtered in 5 Min. | Filtration: % Filtered in 15 Min. | Filtration: % Unfiltered after 4 Hr. |
|---|---|---|---|---|---|---|---|---|
| 33 | $CaSO_4.2H_2O$ (5.0) | 600 | 4.0 | 4.4 | — | 25 | 50 | 20 |
| 34 | $CaSO_4.2H_2O$ (5.0) | 600 | 1.0 | 1.0 | — | 10 | 25 | 75 |
| 35 | $CaSO_4.2H_2O$ (5.0) | 700 | 1.0 | 7.4 | 8.8 | 100 | 100 | 0 |
| 36 | $CaSO_4.2H_2O$ (5.0) | 725 | 1.0 | 14.8 | 7.4 | 100 | 100 | 0 |
| 37 | $CaSO_4.2H_2O$ (2.5) $NH_4H_2PO_4$ (0.5) | 725 | 1.0 | 10.8 | 3.5 | 100 | 100 | 0 |
| 38 | $NH_4H_2PO_4$ (1.0) | 725 | 1.0 | 10.8 | 2.7 | 100 | 100 | 0 |
| 39 | $NH_4H_2PO_4$ (0.5) $CaSO_4.2H_2O$ (2.5) | 725 | 1.0 | 16.4 | 4.5 | 100 | 100 | 0 |
| 40 | (11-46-0) fertilizer (1.0) | 650 | 4.0 | 6.0 | 4.2 | 100 | 100 | 0 |
| 41 | $CaSO_4.2H_2O$ (3.0) $Al_2(SO_4)_3$ (1.0) $MgSO_4$ | 650 | 4.0 | 8.0 | 2.4 | 100 | 100 | 0 |
| 42 | $CaSO_4.2H_2O$ (5.0) | 500 | 1.0 | 4.0 | — | 10 | 20 | 80 |
| 43 | — | — | — | — | — | — | — | — |

TABLE IV

| Sample No. | Pretreatment Chemical % wt/vol | Contacting Temp (°F.) | Contacting Time (hr.) | Filtrate Product: Vis @ 40° C. (cs) | Filtrate Product: Vis @ 100° C. (cs) | Pb ppm | Ca ppm | Al ppm | Fe ppm | Zn ppm |
|---|---|---|---|---|---|---|---|---|---|---|
| 22 | $CaSO_4.2H_2O$ (5.0) | 650 | 4.0 | 35.71 | 5.91 | 14 | 9 | 2 | 5 | 4 |
| 23 | $H_3PO_4$(85%) (1.0) | 650 | 4.0 | 39.20 | 6.13 | 3 | <1 | 2 | <1 | <1 |
| 24 | $CaSO_4.2H_2O$ (2.5) $H_3PO_4$(85%) (0.5) | 650 | 4.0 | 36.53 | 5.97 | 3 | <1 | 2 | <2 | <1 |
| 25 | $CaSO_4.2H_2O$ (2.0) | 650 | 4.0 | 37.49 | 6.00 | 12 | 24 | <2 | 5 | 7 |
| 26 | $MgSO_4.7H_2O$ (5.0) | 650 | 4.0 | 37.74 | 5.98 | 10 | 1 | 2 | <2 | 5 |
| 27 | Gypsum (5.0) | 650 | 4.0 | 35.26 | 5.66 | 6 | <1 | 5 | <2 | 2 |
| 28 | $Al_2SO_4.18H_2O$ (5.0) | 650 | 4.0 | 40.40 | 6.19 | 2 | <1 | tr | tr | <1 |
| 29 | $NH_4H_2PO_4$ (1.0) | 650 | 4.0 | 40.16 | 6.16 | <2 | <1 | <1 | tr | <1 |
| 30 | $NH_4HSO_4$ (1.0) | 650 | 4.0 | 38.41 | 6.09 | <2 | <1 | tr | tr | <1 |
| 31 | $MgSO_4.7H_2O$ (1.0) | 650 | 4.0 | 39.10 | 6.23 | <2 | <1 | tr | tr | 4 |
| 32 | $CaHPO_4$ (1.0) | 650 | 4.0 | 38.54 | 6.17 | <2 | 1 | tr | <1 | 5 |
| 33 | $CaSO_4.2H_2O$ (5.0) | 600 | 4.0 | 46.34 | 7.03 | 7.03 | 190 | 255 | <1 | 42 |
| 34 | $CaSO_4.2H_2O$ (5.0) | 600 | 1.0 | 48.63 | 7.40 | 47 | 280 | 2 | 20 | 420 |
| 35 | $CaSO_4.2H_2O$ (5.0) | 700 | 1.0 | 35.69 | 5.88 | 2 | 3 | <1 | 1 | 80 |
| 36 | $CaSO_4.2H_2O$ (5.0) | 725 | 1.0 | 34.70 | 5.77 | 2 | <1 | tr | <1 | 11 |
| 37 | $CaSO_4.2H_2O$ (2.5) $NH_4H_2PO_4$ (0.5) | 725 | 1.0 | 35.89 | 5.85 | 2 | 1 | tr | <1 | 5 |
| 38 | $NH_4H_2PO_4$ (1.0) | 725 | 1.0 | 38.12 | 6.06 | 2 | <1 | tr | <1 | 4 |
| 39 | $NH_4H_2PO_4$ (0.5) $CaSO_4.2H_2O$ (2.5) | 725 | 1.0 | 40.05 | 6.22 | 11 | <1 | 1 | tr | 2 |
| 40 | (11-46-0) fertilizer (1.0) | 650 | 4.0 | 34.98 | 5.74 | 9 | 2 | <1 | <1 | 2 |
| 41 | $CaSO_4.2H_2O$ (3.0) $Al_2(SO_4)_3$ (1.0) $MgSO_4$ (1.0) | 650 | 4.0 | 33.33 | 5.52 | 10 | 4 | 2 | 1 | 5 |
| 42 | $CaSO_4.2H_2O$ (5.0) | 500 | 1.0 | 49.69 | 7.68 | 240 | 120 | 100 | 70 | 1400 |
| 43 | — | — | — | 76.03 | 12.32 | 678 | 320 | 110 | 106 | 2200 |

The embodiments of the invention in which an exclusive property or privilege is claimed are defined as follows:

1. A process for removing contaminants from waste lubricating oil, said contaminants arising from detergent dispersant agents and the wear of mechanical parts, comprising the steps of:

contacting the waste lubricating oil in the absence of added water with a pretreatment chemical selected from the group consisting of ammonium sulphate, ammonium bisulphate, ammonium dihydrogen phosphate, phosphoric acid, calcium sulphate, aluminum sulphate, magnesium sulphate, sodium sulphate and mixtures thereof, at a temperature in the range of about 650° F. to 725° F. for a time sufficient to render the greatest part of the contaminants removable by filtration; and then filtering the oil mixture to obtain a filtrate product reduced in contaminant content.

2. The process as set forth in claim 1, which further comprises:

removing light ends simultaneously with the contacting step.

3. The process as set forth in claim 2, wherein:

the filtration step is performed at a temperature in the range of about 200° to 350° F.

4. The process as set forth in claim 1, wherein:

the pretreatment chemical is selected from the group consisting of ammonium sulphate, ammonium bisulphate, ammonium dihydrogen phosphate, diammonium monohydrogen phosphate, phosphoric acid, calcium hydrogen phosphate, magnesium sulphate and mixtures thereof, and is included in an amount greater than about 0.5% wt/vol.

5. The process as set forth in claim 1, wherein:

the pretreatment chemical is selected from the group consisting of calcium sulphate, aluminum sulphate, sodium sulphate, and mixtures thereof, and is included in an amount greater than about 4.0% wt/vol.

6. The process as set forth in claim 1, wherein:

the pretreatment chemical includes one or more of ammonium sulphate, ammonium bisulphate, ammonium dihydrogen phosphate, diammonium phosphate, magnesium sulphate and phosphoric acid included in an amount less than about 0.5% wt/vol, and one or more of calcium sulphate, aluminum sulphate, and sodium sulphate included in an amount greater than about 2.0% wt/vol.

* * * * *